US006257314B1

(12) United States Patent
Kuo

(10) Patent No.: US 6,257,314 B1
(45) Date of Patent: Jul. 10, 2001

(54) RADIATOR SHAPING DEVICE

(75) Inventor: Dah-Chyi Kuo, Taipei (TW)

(73) Assignee: Chaun-Choung Industrial Corp., Sanchung (TW)

( * ) Notice: Subject to any disclaimer, the term of this patent is extended or adjusted under 35 U.S.C. 154(b) by 0 days.

(21) Appl. No.: 09/321,107

(22) Filed: May 27, 1999

(51) Int. Cl.[7] ..... B22D 17/26; B22D 17/24
(52) U.S. Cl. ..... 164/342; 164/333; 164/334
(58) Field of Search ..... 164/342, 333, 164/334, 112

(56) References Cited

U.S. PATENT DOCUMENTS 5,533,257 * 7/1996 Romero et al. ..... 164/98
5,562,146 * 10/1996 Harmon et al. ..... 164/333

* cited by examiner

*Primary Examiner*—Harold Pyon
*Assistant Examiner*—I.-H. Lin

(74) *Attorney, Agent, or Firm*—Rosenberg, Klein & Lee

(57) ABSTRACT

A radiator shaping device comprises a lower mold, an upper mold, and two movable molds. The lower mold is installed with a lower chamber; The upper mold installed with an upper chamber, after the lower mold and the upper mold are engaged, a closing space is formed therewithin. The movable molds having a plurality of inserting plates which serves to insert into the fins at two ends of an aluminum folded radiating piece so as to support the folded radiating piece from the two ends thereof. Then it is further placed into the closing space for separating the space as a lower space and an upper space. Next, aluminum liquid is filled into the filling hole of the upper mold. After cooling, the mold is detached, therefore, a high heat dissipating radiator with a lower plate integrally formed in the lower surface of a folded radiating piece is formed by above components. Especially, by the shaping device of the present invention, the aluminum folded radiating piece and the lower plate can be combined together and have identical property. Thus, the heat conductive glue or other material for adhesion is unnecessary. Thus, heat conduction is more rapid, directly and steadily. The defect of prior art radiator in which glue connection is adapted is overcome by the present invention.

6 Claims, 7 Drawing Sheets

RADIATOR SHAPING DEVICE

FIELD OF THE INVENTION

The present invention relates to a radiator shaping device which serves in manufacturing a radiator with a high heat conductivity, thus the radiator may be used to effectively and rapidly cool electronic elements with high heat generation.

BACKGROUND OF THE INVENTION

The radiator 1 of a conventional electronic elements is illustrated in FIG. 1, the structure thereof is formed by aluminum material By aluminum extrusion or press molding, a lower plate 10 and a plurality of spaced fins 11 stand upright at the lower plate so that by the increment of area and the slots 12 between the fins 11, a heat dissipating function is achieved. However, in the radiator 1 made by aluminum extrusion or press molding, the widths of the fins 11 are limited and thus can not be reduced to a desired size. Namely, the fins 11 shaped from a lower plate 10 with the same area are finite. Therefore. under the confinement of the same area and height, the total area of heat dissipation can not be increased greatly.

Therefore, a radiator with the same area and height but having a large heat dissipating area has been developed. As shown in FIG. 2, the radiator 2 has a U shaped lower plate 20. A folded radiating piece formed by folding single thin aluminum piece is fixed in the U shape space. By the character that the width of the piece is very thin, more fins 210 and slots 211 are formed on the same area and height. However, this aluminum folded radiating piece 21 is adhered to the aluminum lower plate 20 by glue (such as head conductive glue) having a bad heat conductivity. Because of the isolation of the glue the heat transformation between the folded radiating piece 21 and the lower plate 20 is poor. Therefore, heat efficiency can not be attained to desired effect. Besides, since the glue is applied between the folded radiating piece 21 and the lower plate 20 and has a physical property different from aluminum. Thus, for a long period of heat expansion and cool contraction, the glue will deteriorate in quality and the adhesion becomes poor so that the contact between the folded radiating piece 21 and the lower plate 20 is worse and thus heat transformation is not preferred. This is necessary to be improved.

SUMMARY OF THE INVENTION

Accordingly, the primary object of the present invention is to provide a radiator shaping device comprising a lower mold, an upper mold and two movable molds. The aluminum folded radiating piece is formed integrally with an aluminum lower plate, thus the radiator may effectively use the folded radiating piece with a large radiating area and a preferred heat radiating effect. Moreover, the folded radiating piece and the lower plate are made of the same material, thus heat is transferred directly and rapidly. Moreover, the structure is more steady. Therefore, the complete heat dissipation effect is improved effectively.

The various objects and advantages of the present invention will be more readily understood from the following detailed description when read in conjunction with the appended drawing.

DETAILED DESCRIPTION OF THE PREFERRED EMBODIMENTS

Figure 1:
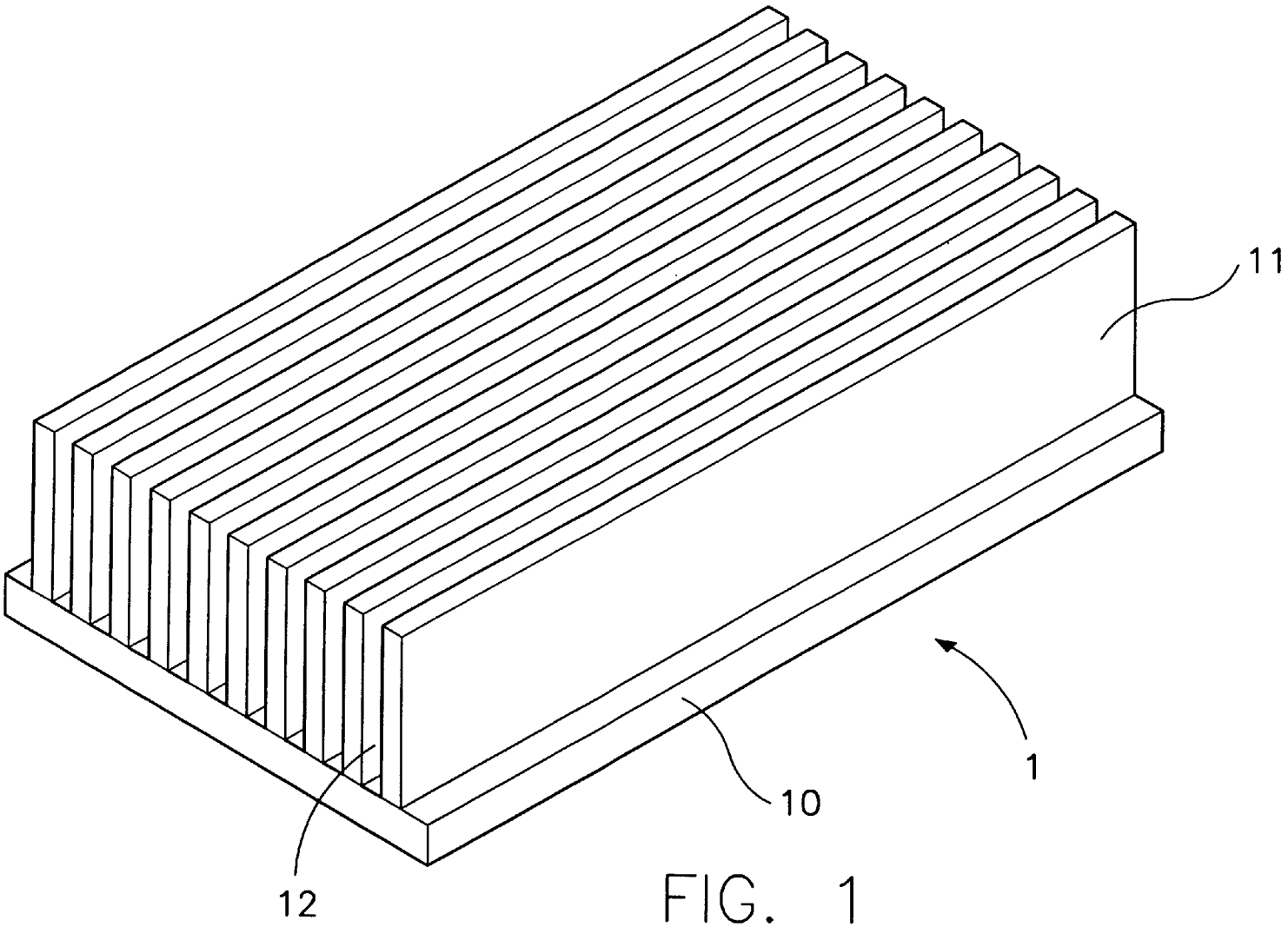
FIG. 1 PRIOR ART
FIG. 1 shows the perspective view of a conventional radiator structure.
Figure 2:
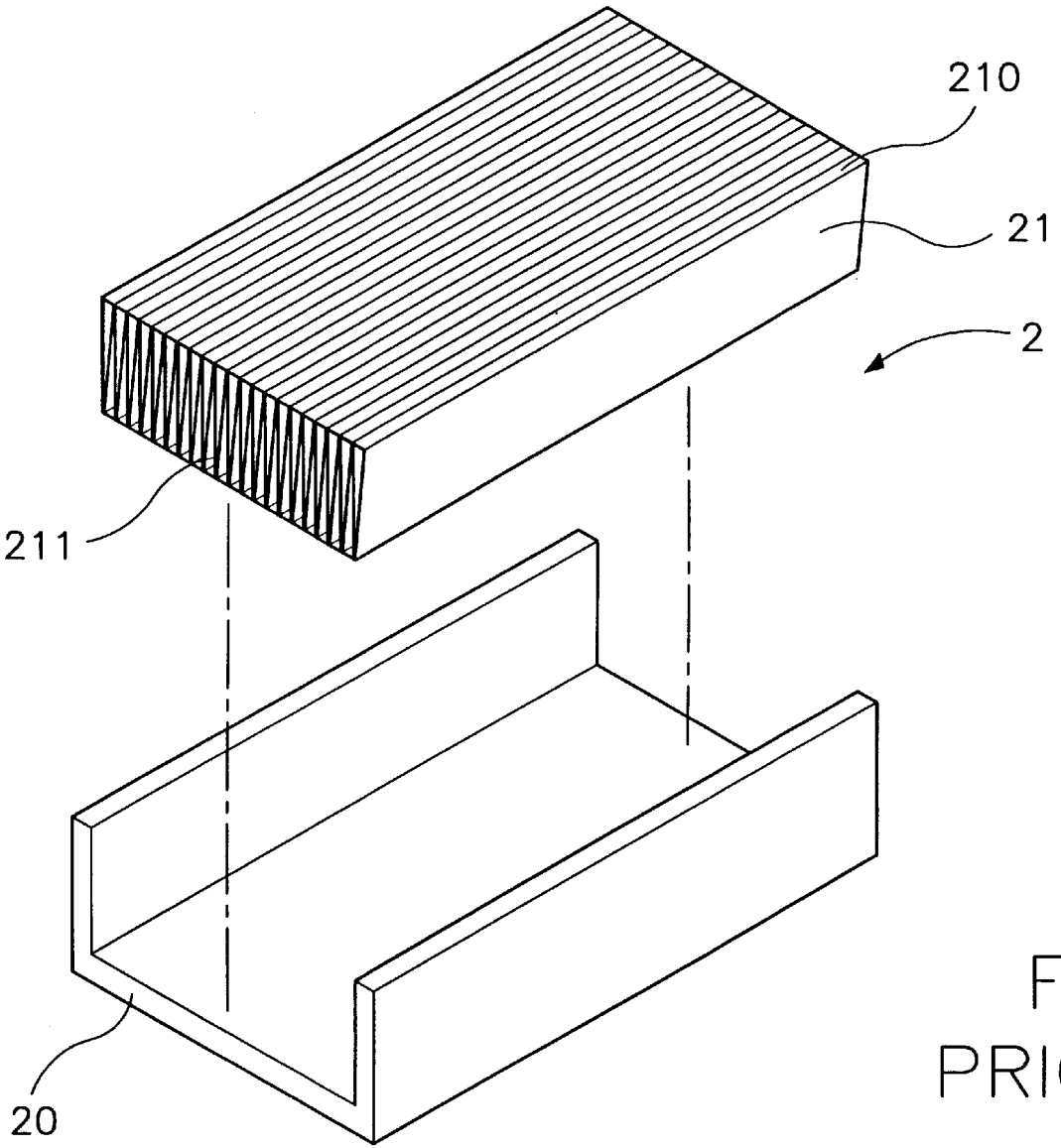
FIG. 2 PRIOR ART
FIG. 2 is a perspective view showing assembly of another radiator.
Figure 3:
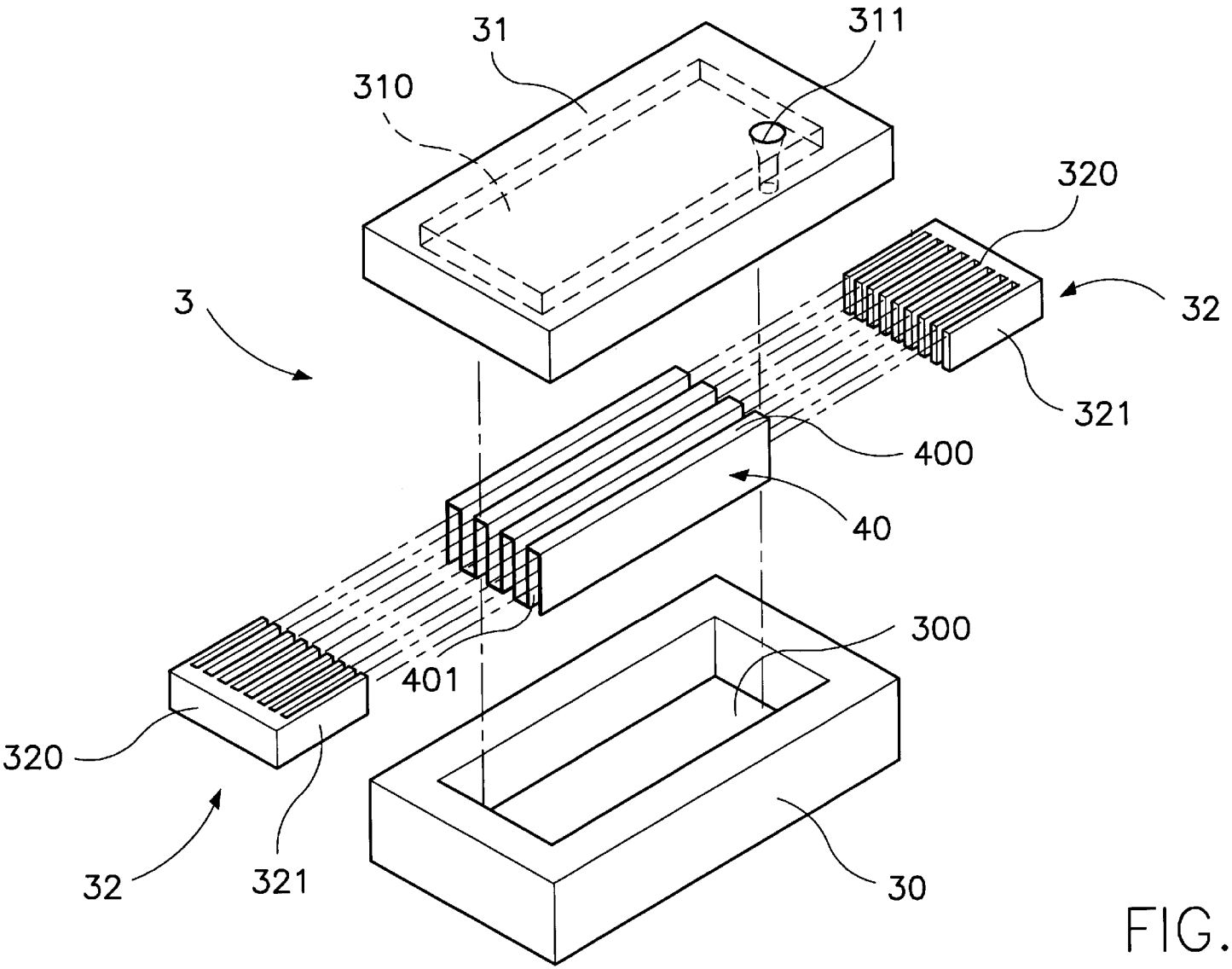
FIG. 3 is an exploded perspective view of the present invention.
Figure 7:
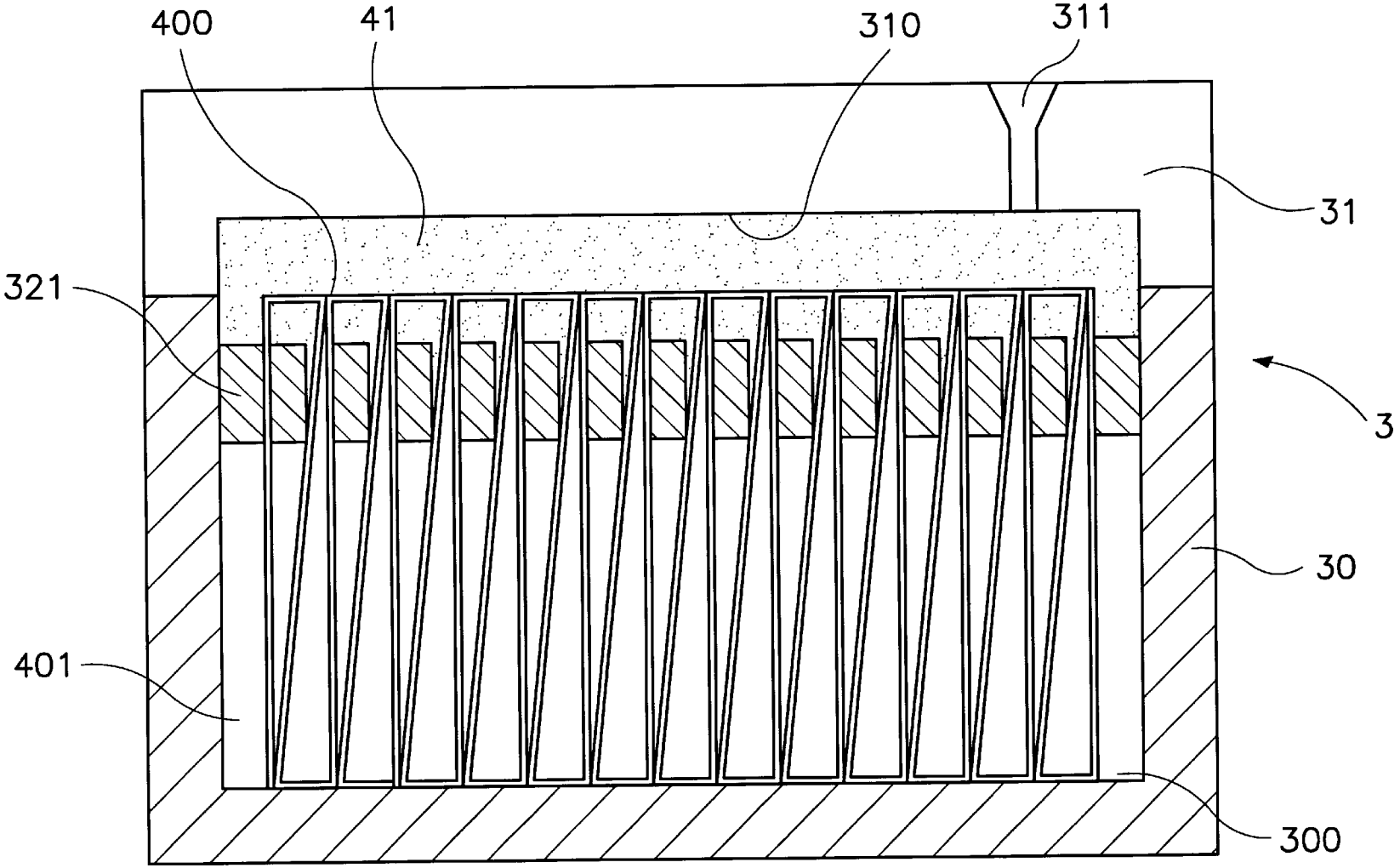
FIG. 7 is a schematic cross sectional view showing the use of further radiator shaped from the present invention.

With reference to FIG. 3, a preferred embodiment for the radiator shaping device according to the present invention is illustrated. The radiator shaping device of the present invention includes a lower mold 30, an upper mold 31 and two movable molds 32. The inner portion of the lower mold 30 has a lower chamber 300 for containing folded radiating piece 40, while the inner portion of the upper mold 31 has an upper chamber 310 with a shallow depth so that a closing chamber is formed as the upper mold and the lower mold are engaged. A plurality of parallel inserting plates are formed on the lower plate 320 of each movable mold 32. The length of each inserting plate 321 may be extended to be as one half of that of the folded radiating piece 40. Thus, two movable molds 32 may be inserted into the slots 401 of the fins 400 at two ends of the folded radiating piece 40 and thus the two movable molds are connected with one another so that the folded radiating piece 40 is supported between the two ends thereof. Adjacent ones of the inserting plates 321 of each movable mold 32 are spaced by a dimension substantially equivalent to a thickness dimension of the radiating piece fin 400 received therebetween in the embodiment shown; but, they may be spaced by different relative dimensions in other embodiments, such as by a dimension sufficient to receive therebetween portions of at least one adjacent pair of radiating piece fin sections (as in the embodiment of FIG. 7). The inserting pieces 321 and fins 400 are in any event accordingly dimensioned such that they tightly engage, with the inserting plates 321 then intermediately partitioning each slot 401 between the fins 400.

Figure 4:
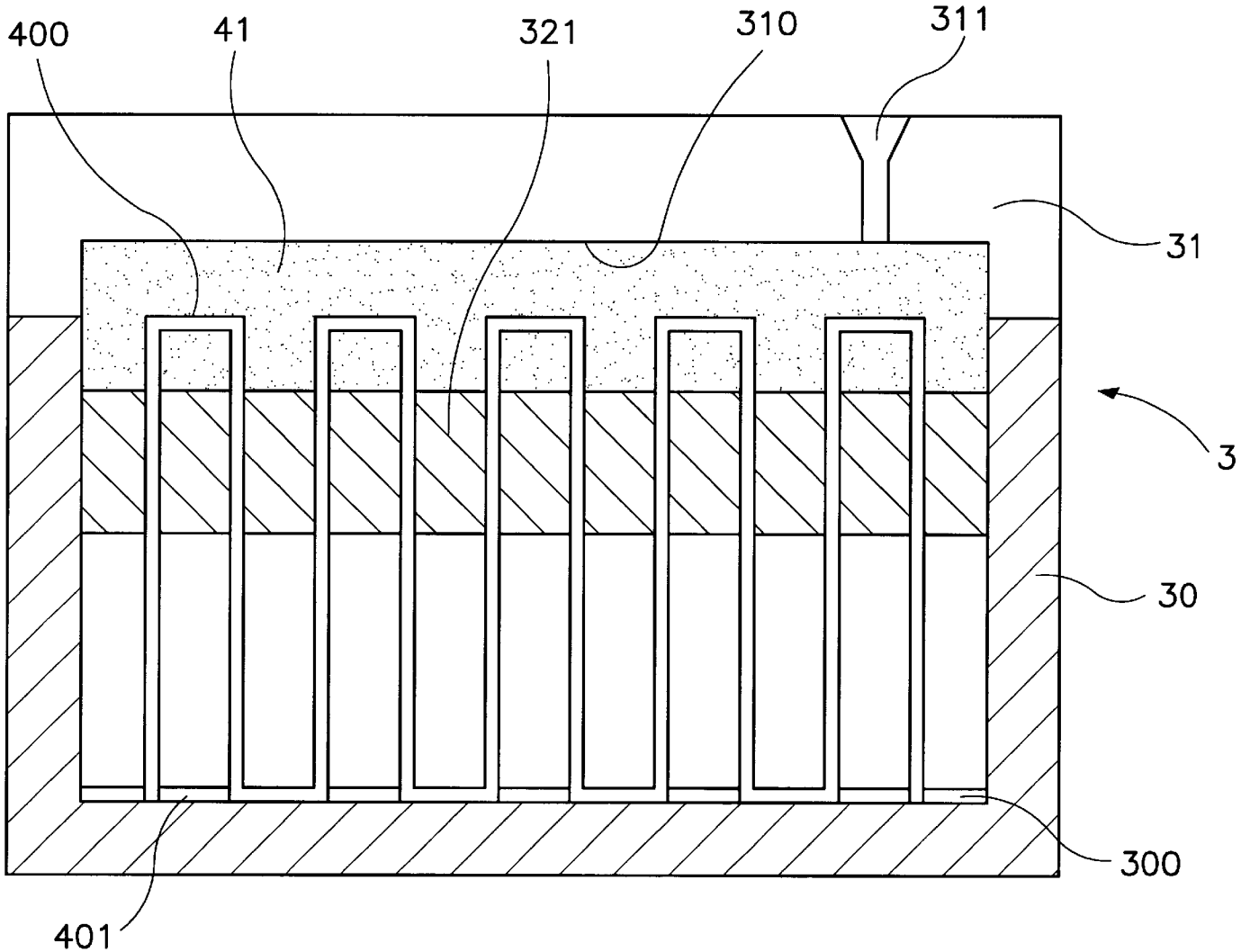
FIG. 4 is a schematic cross sectional view showing the use of the radiator according to the present invention.
Figure 5:
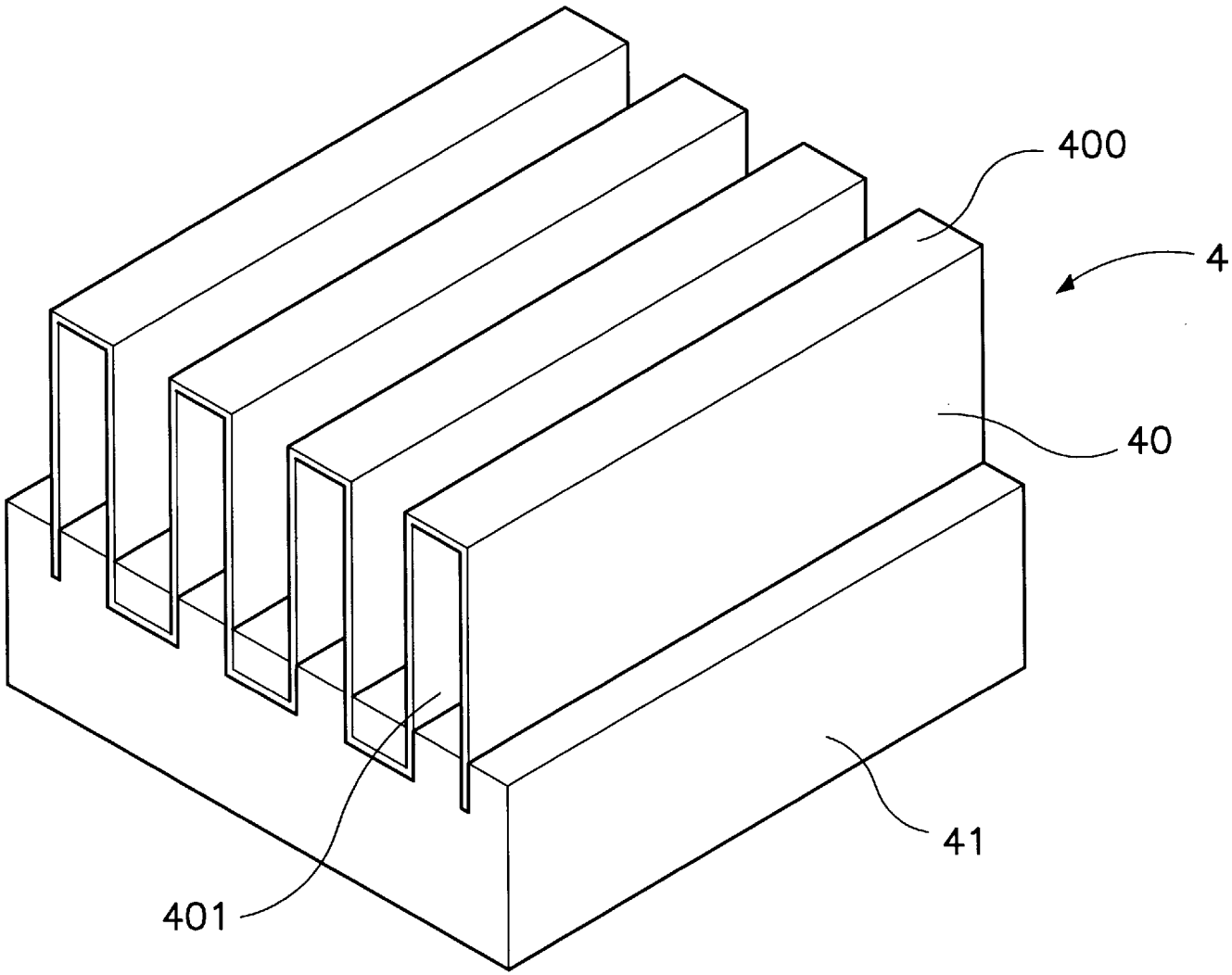
FIG. 5 shows the perspective view of a radiator shaped according to the present invention.
Figure 6:
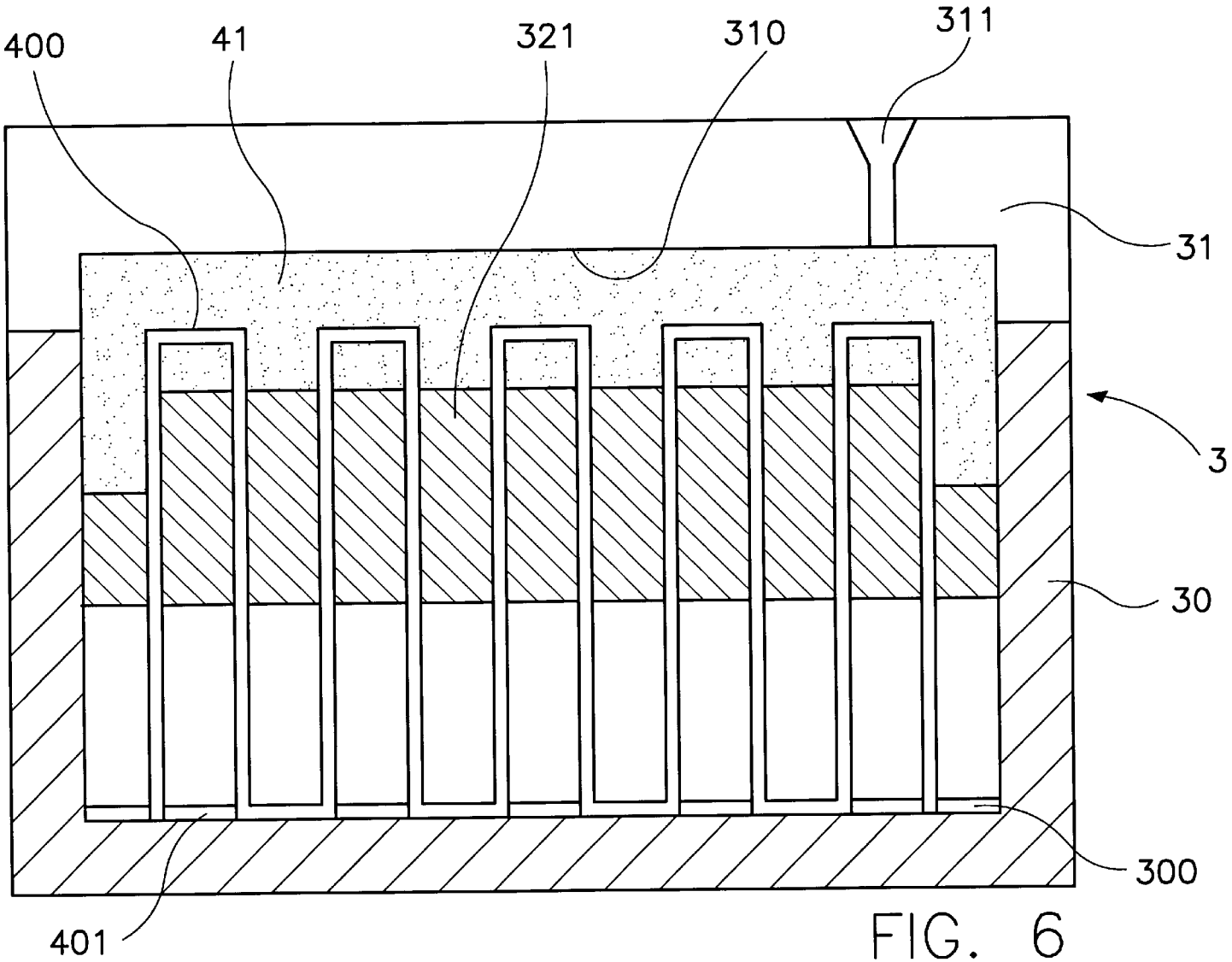
FIG. 6 is a schematic cross sectional view showing the use of another radiator shaped from the present invention.

Accordingly, if a radiator is desired to be shaped, at first, the two movable molds 32 serve to support the folded radiating piece 40. Then the folded radiating piece 40 and the two movable molds 32 are placed in the lower chamber 300 of the lower mold 30, so that the folded radiating piece 40 and the two movable molds 32 may be tightly inserted within the peripheral wall of the lower chamber 300 so that the upper and lower spaces are isolated. Then, the upper mold 31 covers the lower mold 30, next, melt aluminum liquid is filled into a filling hole 311, as shown in FIG. 4. At this time, due to the isolation of the folded radiating piece 40 and the two movable molds, the aluminum liquid is contained only in the upper chamber of the folded radiating piece 40 and tightly contacts the top surface of the folded radiating piece 40. After the aluminum liquid is cooled, it will become a single piece integrally formed with the folded radiating piece 40. Thus, under the condition of same area and height, the folded radiating piece 40 has a larger radiating area than the conventional aluminum extruding or pressing molding radiator. Especially, by the shaping device 3 of the present invention, the aluminum folded radiating piece 40 and the lower plate 41 can be combined together and have identical property. Thus the heat conductive glue or other material for adhesion is unnecessary. Thus, heat conduction is more rapid, directly and steadily. Moreover, since the folded radiating piece 40 and the lower plate 41 are formed by welding, thus, the connection therebetween is strong and stable.

The physical reactions for the hot expansion and cold contraction are identical. Thus, the radiator will not deteriorate in quality or become loose. Therefore, the effect of heat transfer is retained.

Accordingly, the radiator shaping device according to the present invention has a preferred heat transferred effect and a well structure, and thus the heat dissipating efficiency is increased.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A radiating device forming assembly comprising:

(a) a lower mold;

(b) an upper mold coupled to said lower mold to substantially enclose an inner chamber therebetween, one of said upper and lower molds having formed therein a filling hole communicating with said inner chamber;

(c) an aluminum radiating piece disposed within said inner chamber, said radiating piece having longitudinally opposed end portions, said radiating piece having a corrugated contour defined by a plurality of substantially parallel fin sections each extending longitudinally between said end portions, adjacent ones of said fin sections defining therebetween a longitudinally extending slot; and, (d) first and second movable molds respectively engaging said end portions of said radiating piece, each said first and second movable mold including a plate portion and a plurality of spaced inserting plates projecting longitudinally therefrom, each said inserting plate inserting into one said radiating piece slot, terminal ends of said first movable mold inserting plate respectively engaging in longitudinally opposed manner terminal ends of said second movable mold inserting plates to thereby partition in said inner chamber substantially isolated upper and lower spaces;

whereby a molten aluminum may be introduced through said filling hole into one of said upper and lower spaces and thereafter solidified to integrally form a radiating device having said fin sections projecting at least partially therefrom.

2. The radiating device forming assembly as recited in claim 1 wherein adjacent ones of said inserting plates of said first and second movable molds are spaced by a dimension substantially equivalent to a thickness dimension of said radiating piece fin section received therebetween.

3. The radiating device forming assembly as recited in claim 1 wherein adjacent ones of said inserting plates of said first and second movable molds are spaced by a dimension sufficient to receive therebetween portions of at least one adjacent pair of said radiating piece fin sections.

4. The radiating device forming assembly as recited in claim 1 wherein each said inserting plate of said first and second movable molds extends along substantially half the longitudinal length of one said radiating piece slot.

5. The radiating device forming assembly as recited in claim 4 wherein the outermost pair of said inserting plates of each said first and second movable molds externally bound respectively the outermost pair of said radiating piece fin sections.

6. The radiating device forming assembly as recited in claim 5 wherein said outermost pair of said inserting plates of each said first and second movable molds are each formed to be less in a height dimension than the other of said fin sections thereof, whereby a radiating device having a substantially U-shaped lower plate portion is formed.

* * * * *